US012404668B2

(12) United States Patent
Harrell et al.

(10) Patent No.: US 12,404,668 B2
(45) Date of Patent: Sep. 2, 2025

(54) PORTABLE DISPENSER FOR DOSING BACTERIA CONCENTRATE INTO SEWER LINES

(71) Applicant: Helix Laboratories, Inc., Dallas, TX (US)

(72) Inventors: John Bradley Harrell, Dallas, TX (US); John Breck Harrell, Dallas, TX (US)

(73) Assignee: Helix Laboratories, Inc., Dallas, TX (US)

( * ) Notice: Subject to any disclaimer, the term of this patent is extended or adjusted under 35 U.S.C. 154(b) by 264 days.

(21) Appl. No.: 18/466,523

(22) Filed: Sep. 13, 2023

(65) Prior Publication Data

US 2025/0084632 A1 Mar. 13, 2025

(51) Int. Cl.
*E03F 9/00* (2006.01)
*E03F 7/00* (2006.01)

(52) U.S. Cl.
CPC . *E03F 9/00* (2013.01); *E03F 7/00* (2013.01)

(58) Field of Classification Search
CPC ..... E03F 9/00; E03F 7/00
See application file for complete search history.

(56) References Cited

U.S. PATENT DOCUMENTS 4,810,385 A * 3/1989 Hater ..... C02F 3/348 210/615

* cited by examiner

*Primary Examiner* — Donnell A Long
(74) *Attorney, Agent, or Firm* — Hovey Williams LLP

(57) ABSTRACT

A portable dispenser hung in a sewer line manhole automatically doses selected quantities of bacteria concentrate and/or other compounds into the sewer line to combat the buildup of organic matter near the source.

20 Claims, 5 Drawing Sheets

PORTABLE DISPENSER FOR DOSING BACTERIA CONCENTRATE INTO SEWER LINES

BACKGROUND

Restaurants, food processing plants, and other establishments often introduce large quantities of grease, fats, oils, carbohydrates, and other organic materials into sewer lines. These organic materials can clog the sewer lines, resulting in sewage backups and associated water damage and undesirable odors. Bacteria concentrate and other treatment solutions are often added to sewage as it is treated in a wastewater treatment plant to degrade the organic materials, but adding such compounds at a wastewater treatment plant doesn't prevent clogs in the sewer lines leading to the wastewater treatment plant. These compounds can also be introduced into the drains at the sources of the organic materials, but this is typically done too infrequently and in the wrong quantities (too little is ineffective, too much is wasteful).

SUMMARY

The present invention solves the above-described problems and similar problems by providing a cost-effective and consistent way to add bacteria concentrate and/or other compounds to sewer lines. An embodiment of the invention is a portable dispenser that can be quickly and easily hung in a sewer line manhole adjacent a restaurant or other establishment and that automatically doses selected quantities of bacteria concentrate and/or other compounds into the sewer line at selected intervals to combat the buildup of organic matter near the source before it becomes a problem.

The dispenser comprises a container for holding a supply of bacteria concentrate or other compound; a strap or other attachment device for hanging the container in the manhole below ground; a pump for pumping the compound from the container to the sewer line; a fluid level switch positioned in the container for sensing a fluid level of the treatment solution in the container; and a control system for periodically operating the pump to dispense doses of the compound into the sewer line and for collecting and transmitting related operational data to external devices.

The control system includes a rechargeable battery for powering the pump and a controller and/or circuitry for operating the pump, monitoring the fluid level in the container, monitoring the charge level of the battery, and performing other control functions. The control system also includes a transmitter for transmitting data representative of the fluid level in the container, the charge level of the battery, and operation of the pump to a mobile phone or other external communication device so that an operator my monitor the status of the dispenser in real-time and refill and recharge the dispenser as needed. Data may also be collected and maintained for multiple dispensers and presented on a dashboard so that one or more operators can monitor the status and operation of multiple dispensers. In some embodiments, each dispenser may also include a receiver or transceiver so as to receive instructions from an external device such as instructions to increase or decrease its dosing amount or frequency.

In some embodiments, the control system is electrically coupled with the pump and the fluid level switch by a quick connect cable that permits it to be easily removed from the manhole for easy configuration and charging. The control system also includes a charging port or connector coupled with the rechargeable battery that may be attached to a charging cable that may be connected to a power source outside the manhole for recharging the rechargeable battery.

Embodiments of the dispenser also include a hose or other conduit that may be connected to a refill supply of bacteria concentrate or other compound so the dispenser may be refilled without removing it from the manhole.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein:

FIG. 1 is a partial vertical sectional view of a dispenser constructed in accordance with an embodiment of the invention shown coupled with a refill container.

FIG. 2. is an elevational view of the dispenser shown installed in a manhole.

Figure 1:
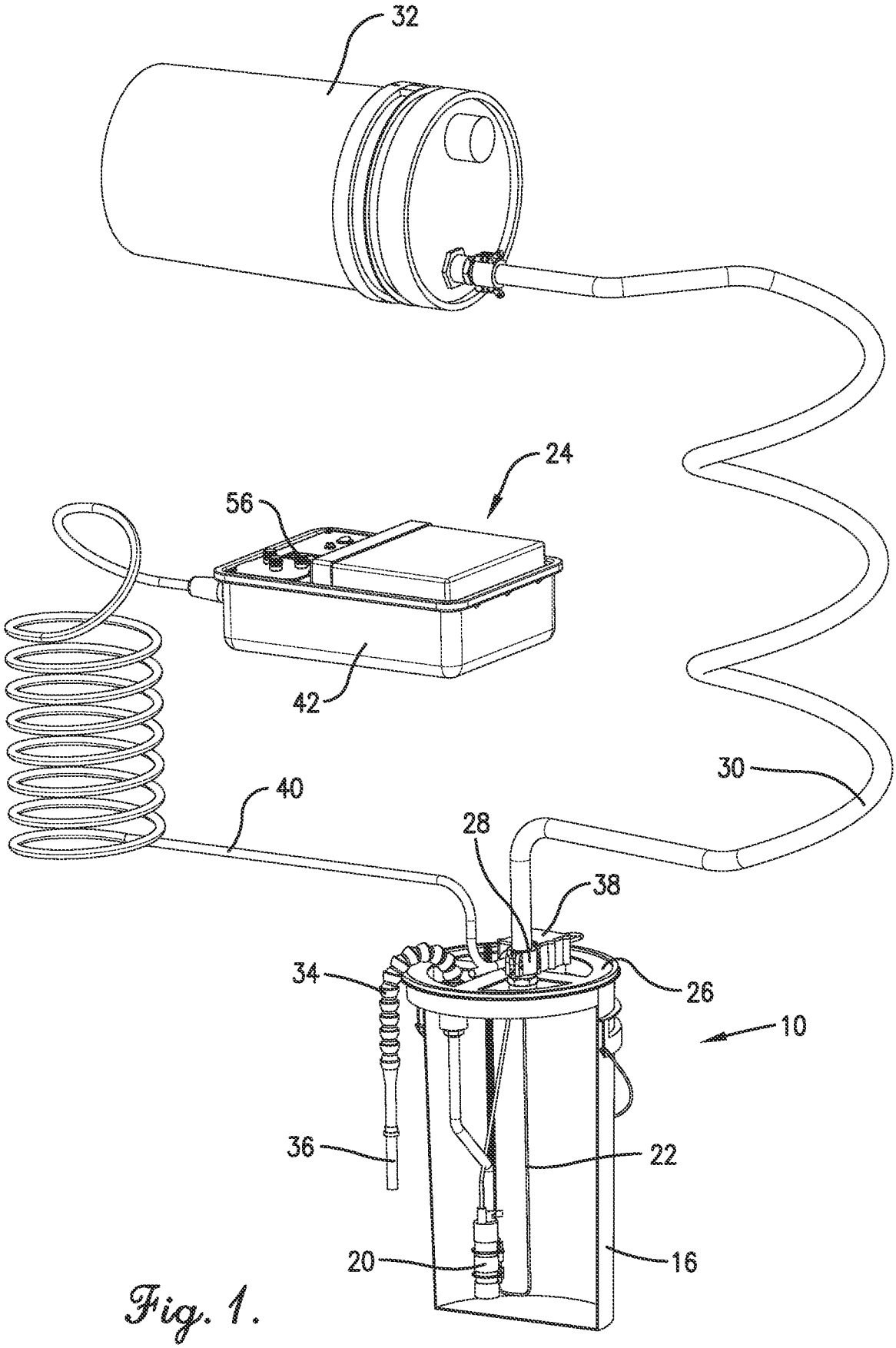

The drawing figures do not limit the present invention to the specific embodiments disclosed and described herein. The drawings are not necessarily to scale, emphasis instead being placed upon clearly illustrating the principles of the invention.

DETAILED DESCRIPTION

Figure 2:
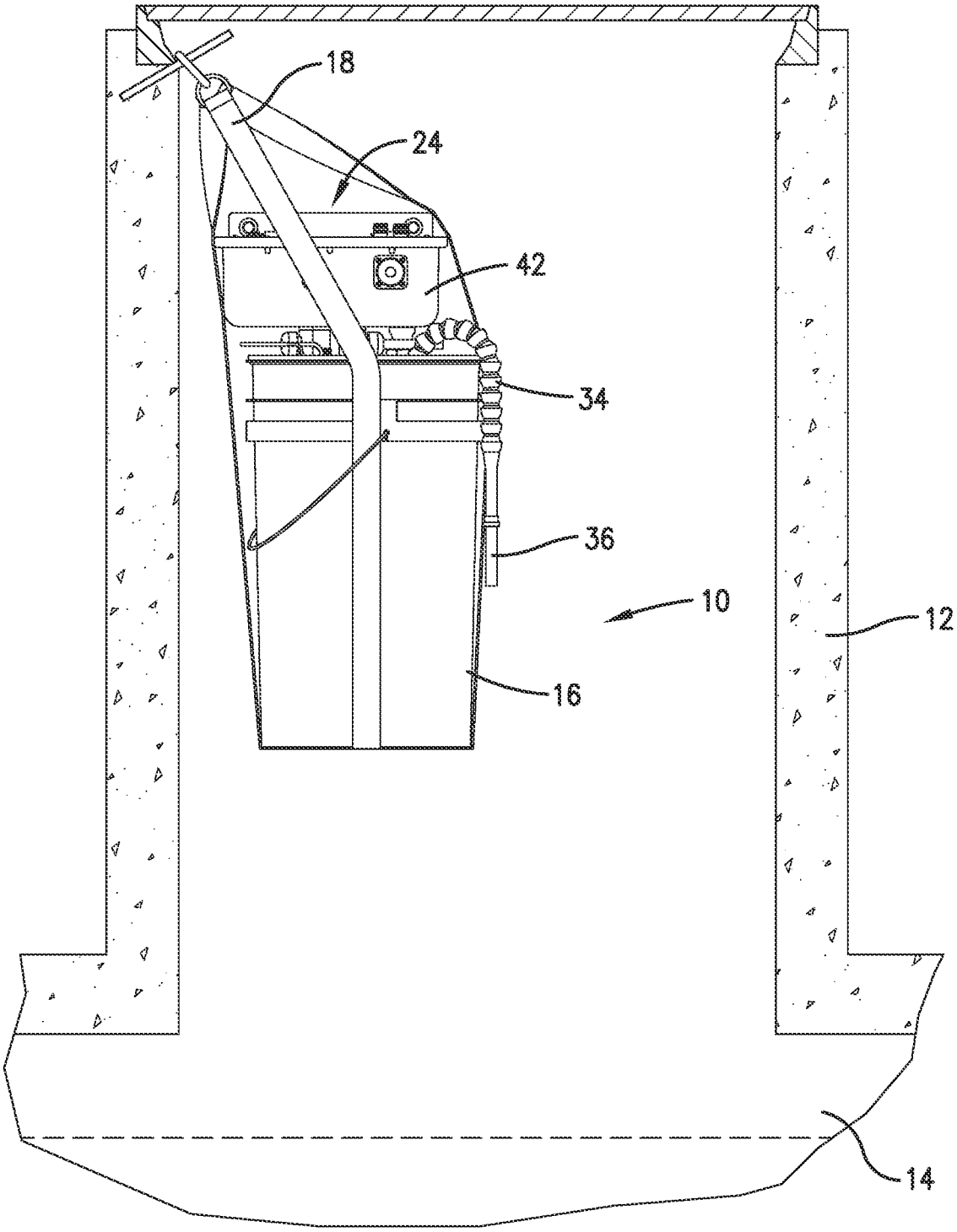
Figure 3:
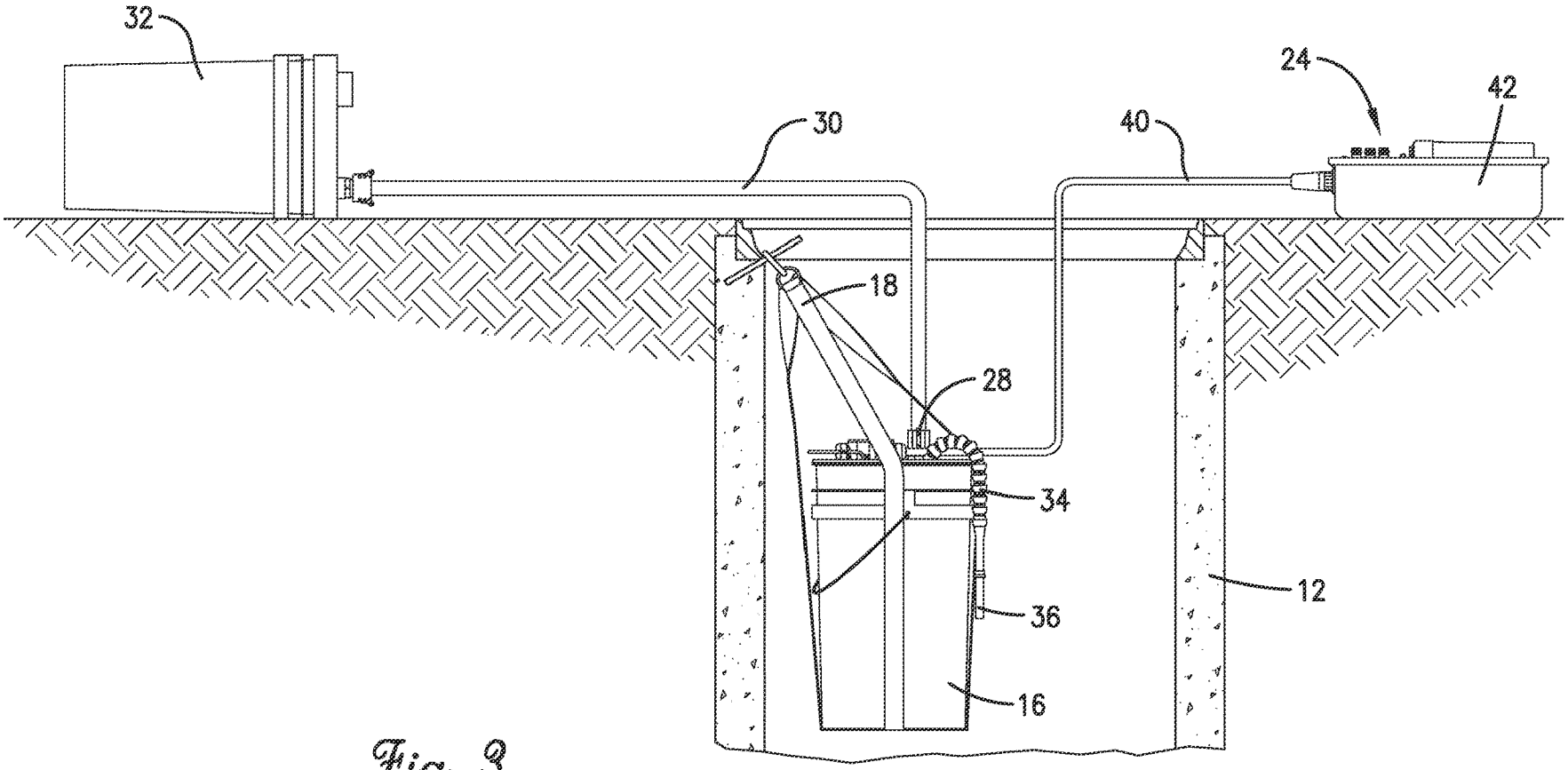
FIG. 3 is an elevational view of the dispenser shown installed in a manhole with its control system removed from the manhole and its container coupled with a refill container.

A dispenser 10 constructed in accordance with embodiments of the invention is illustrated in the attached drawing figures. As best shown in FIGS. 2 and 3, the dispenser can be quickly and easily hung in a manhole 12 of a sewer line 14 adjacent a restaurant or other establishment. As described in more detail below, the dispenser automatically doses selected quantities of bacteria concentrate and/or other compounds into the sewer line 14 at selected intervals to combat the buildup of organic matter near the source before it becomes a problem. The dispenser also transmits operational data to external communication devices for service and maintenance purposes and may receive control instructions from the external devices.

An embodiment of the dispenser 10 broadly comprises a container 16; an attachment device 18; a pump 20; a fluid level switch 22; and a control system 24. These and other components of the dispenser described below may be "off the shelf" components that are assembled together to form a complete dispenser or may be special purpose components and manufactured specifically for the dispenser.

The container 16 holds a supply of bacteria concentrate or other compound and may be any shape, size, and configuration. In one embodiment, the container 16 is a 7 gallon plastic bucket with a gamma type lid 26. To simplify refilling of the container, embodiments of the dispenser 10 also include a fluid transfer fitting 28 in the lid that may coupled with a hose or other conduit 30 that may be connected to a refill container 32 of bacteria concentrate or other compound to refill the container 16 without removing it from the manhole.

The attachment device 18 hangs the container 16 from a hook or other anchor in the manhole 12 and may be a strap, handle, hook, piece of rope or any other similar mechanism. The attachment device 18 may be integrated into the container or be a separate mechanism attached to the container.

The pump 20 discharges compounds from the container 16 to the sewer line 14 when directed to do so by the control system 24. In one embodiment, the pump 20 is a 600 liter per hour submersible pump positioned inside the container 16, but it may be any type of pump and may be positioned inside or outside the container. The outlet of the pump is connected to a Snap-loc coolant hose 34 or other fluid-carrying conduit that can be shaped and/or positioned to aim the pumped compounds into the sewer line. A check valve 36 may be attached to the distal end of the hose. The pump 20 may be connected to the control system 24 via an electrical junction box 38 on the lid of the container that relays power and signals via a quick connect cable 40.

The fluid level switch 22 senses the level of bacteria concentrate or other compounds in the container 16. The fluid level switch 22 is preferably a float-type switch, but it may be any level sensing device. The fluid level switch may be connected to the control system via the electrical junction box 38 to relay power from and signals to the control system via the quick connect cable 40.

The control system 24 controls operation of the pump and other components of the dispenser, monitors the status of the fluid level switch and the control system's rechargeable battery, and relays useful data to external devices operated by maintenance personnel or others. The control system 24 can be implemented with hardware, software, firmware, or a combination thereof and is preferably housed in a control box 42 positioned on top of the lid 26 of the container 16. As discussed herein, the control system periodically operates the pump to dispense doses of the bacteria concentrate or other compounds held in the container to the sewer line. The control system also monitors the level switch and disables the pump when the level switch senses a low fluid level in the container.

Figure 4:
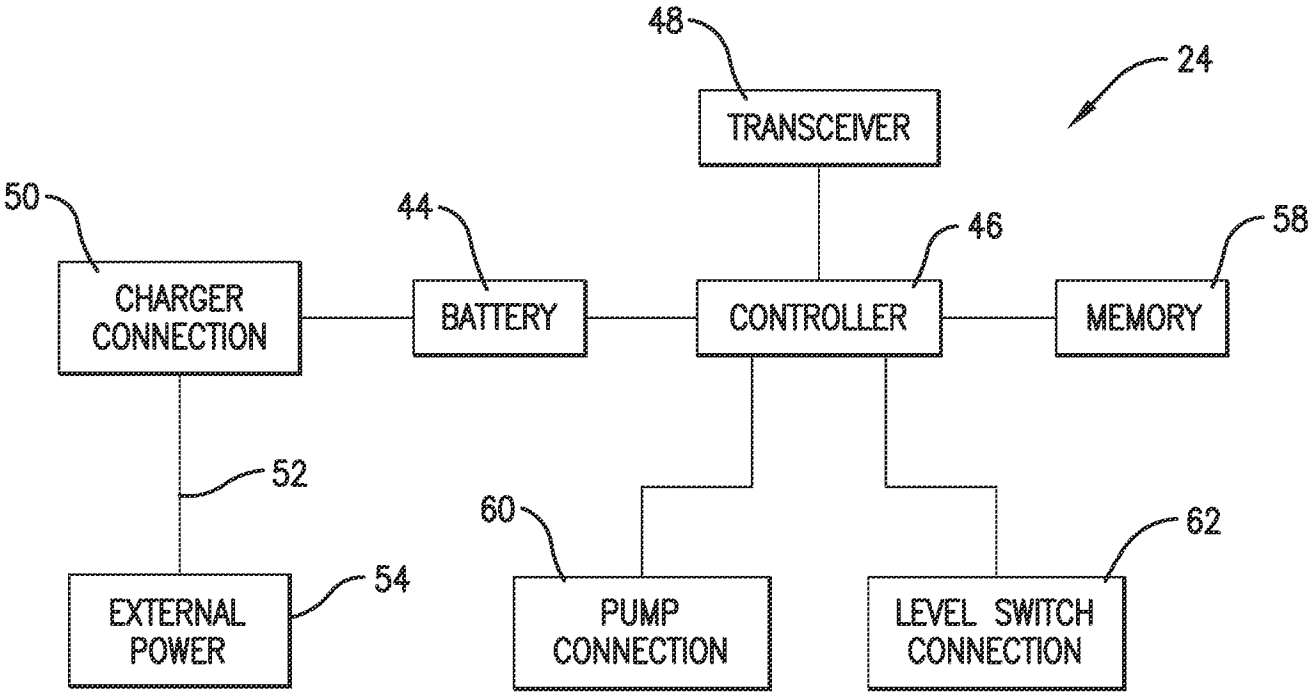
FIG. 4 is a block diagram of the control system of the dispenser.

Selected components of an exemplary control system 24 are illustrated in FIG. 4 and include a rechargeable battery 44; a controller 46; and a transmitter or transceiver 48. The control system may also include conventional input devices such as knobs, buttons, switches, dials, etc.; inputs for receiving programs and data from external devices; one or more displays; fuses; and various electronics.

The rechargeable battery 44 is preferably a 12-volt, 100-amp hour lithium iron phosphate battery that is capable of powering the pump and other components of the control system for long periods of time between charging. The battery 44 is electrically connected to a charging port or connector 50 that can be attached to a charging cable 52 this is in turn connected to a power source 54 outside the manhole for recharging the rechargeable battery. The control system also includes a gauge and display 56 for approximating and displaying the charge level of the battery.

The controller 46 may comprise or include any number or combination of processors, controllers, ASICs, computers, discreet electronics or other control circuitry and may include or be connected with memory 58. As illustrated in FIG. 3, the controller includes connectors or outputs 60, 62 for powering and controlling the pump and monitoring the level switch. In some embodiments, the controller is electrically coupled with the pump and the level switch by a quick connect cable 64 that permits the controller to be easily removed from the manhole for easy configuration.

Some of the functions of the control system may be implemented with one or more computer programs executed by the controller 46. Each computer program comprises an ordered listing of executable instructions for implementing logical functions and can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any means that can contain, store, communicate, propagate or transport the program for use by or in connection with the instruction execution system, apparatus, or device including, but not limited to, the memory. The computer-readable medium can be, for example, but not limited to, an electronic, magnetic, optical, electro-magnetic, infrared, or semi-conductor system, apparatus, device, or propagation medium. More specific, although not inclusive, examples of the computer-readable medium would include the following: an electrical connection having one or more wires, a random access memory (RAM), a read-only memory (ROM), an erasable, programmable, read-only memory (EPROM or Flash memory), an optical fiber, and a portable compact disk read-only memory (CDROM).

The memory 58 may be any electronic memory that can be accessed by the controller and operable for storing instructions or data. The memory 58 may be integral with the controller 46 or may be external memory. The memory may be a single component or may be a combination of components that provide the requisite functionality. The memory may include various types of volatile or non-volatile memory such as flash memory, optical discs, magnetic storage devices, SRAM, DRAM, or other memory devices capable of storing data and instructions. The memory may communicate directly with the controller or may communicate over a bus or other mechanism that facilitates direct or indirect communication. The memory may optionally be structured with a file system to provide organized access to data existing thereon.

The transmitter 48 is coupled with the controller 46 for transmitting service and maintenance data to external devices. The transmitted data may be representative of the fluid level in the container, the charge level of the rechargeable battery, and operation of the pump. In some embodiments, the transmitter is a transceiver for receiving data or instructions from an external device such as instructions to increase or decrease the dispenser's dosing amount or frequency. The transmitter/transceiver may be a cellular or other radio transceiver; a Bluetooth transceiver; a WiFi transceiver; and/or any other transmitting/receiving device.

Figure 5:
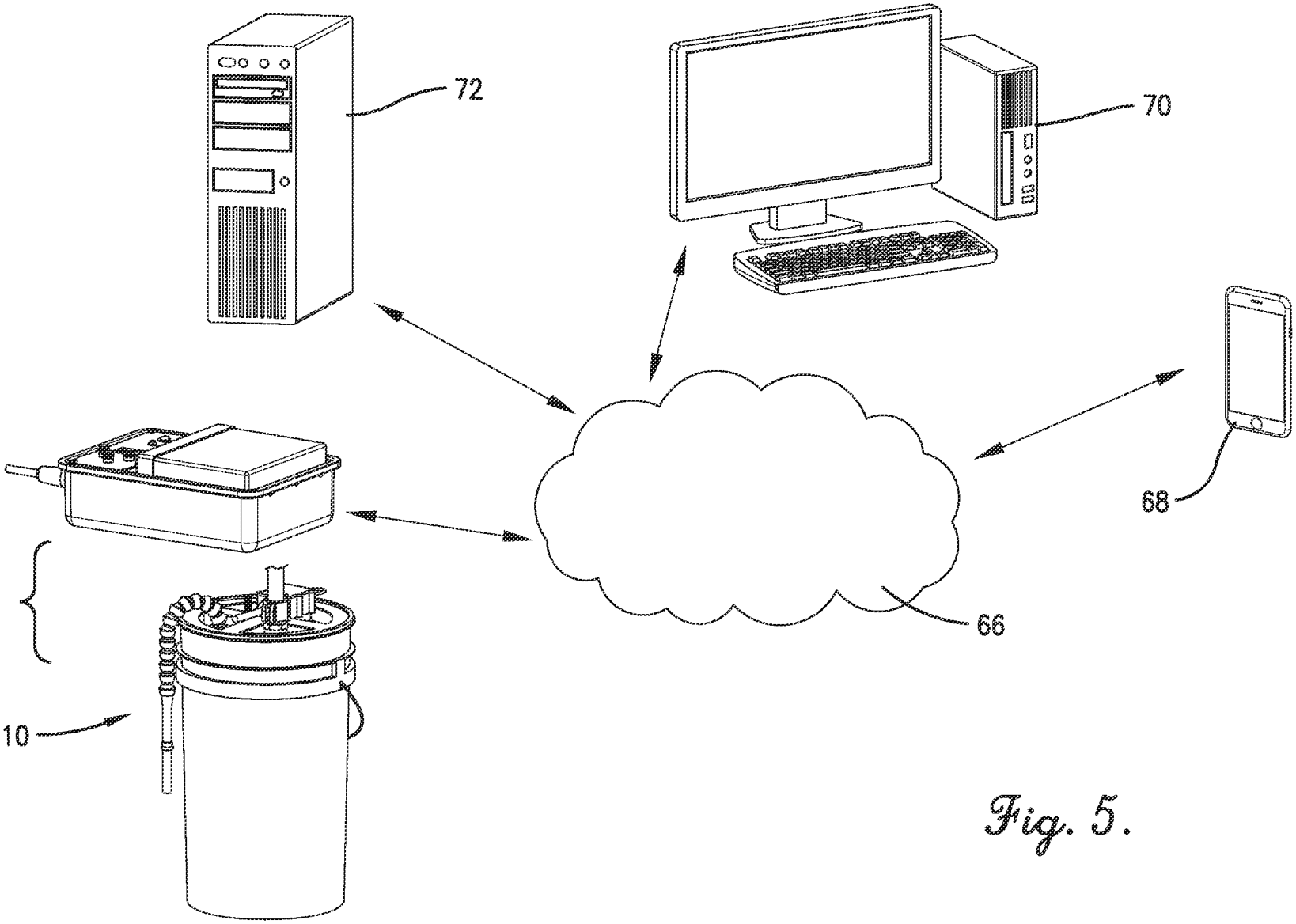
FIG. 5 is a block diagram of the control system, external computing devices, and a communications network.

In one embodiment illustrated in FIG. 5, the transmitter 48 may upload data to a communications network 66 for relay to a mobile phone 68, a desktop computer 70, and/or a server computer 72 so that one or more operators my monitor the status of the dispenser 10 in real-time. The communications network 66 may a local area network, a wide area network, or an intranet and may include or be in communication with a wireless network capable of supporting wireless communications. The wireless network may include conventional switching and routing equipment. The communications network and wireless network may also be combined or implemented with several different networks.

One of the external devices 68, 70, 72 may also receive and maintain data from multiple dispensers and present the data on a dashboard or other user interface so that operators can monitor the status and operation of multiple dispensers.

In some embodiments, the control system 24 may also comprise a GPS receiver or other location-determining component so that the controller 46 and transmitter 48 may transmit location data to external computing devices so operators can easily locate dispensers that need to be refilled, recharged, or other maintenance. This permits a dispenser to be moved to different locations and still be easily located.

Some or all of the components of the control system 24 may be enclosed in or supported on a weatherproof housing for protection from moisture, vibration, and impact. The housing may be constructed from a suitable vibration and impact-resistant material such as, for example, plastic, nylon, aluminum, or any combination thereof and may include one or more appropriate gaskets or seals to make it substantially waterproof or resistant.

The above-described components of the control system 24 need not be physically connected to one another since wireless communication among the various depicted components is permissible and intended to fall within the scope of the present invention. Thus, portions of the control system 24 may be located remotely from the dispenser 10 and from each other. The components of the control system illustrated and described herein are merely examples of equipment that may be used to implement embodiments of the present invention and may be replaced with other equipment without departing from the scope of the present invention.

ADDITIONAL CONSIDERATIONS

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of routines, subroutines, applications, or instructions. These may constitute either software (e.g., code embodied on a machine-readable medium or in a transmission signal) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as computer hardware that operates to perform certain operations as described herein.

In various embodiments, computer hardware, such as a processing element, may be implemented as special purpose or as general purpose. For example, the processing element may comprise dedicated circuitry or logic that is permanently configured, such as an application-specific integrated circuit (ASIC), or indefinitely configured, such as an FPGA, to perform certain operations. The processing element may also comprise programmable logic or circuitry (e.g., as encompassed within a general-purpose processor or other programmable processor) that is temporarily configured by software to perform certain operations. It will be appreciated that the decision to implement the processing element as special purpose, in dedicated and permanently configured circuitry, or as general purpose (e.g., configured by software) may be driven by cost and time considerations.

Accordingly, the term "processing element" or equivalents should be understood to encompass a tangible entity, be that an entity that is physically constructed, permanently configured (e.g., hardwired), or temporarily configured (e.g., programmed) to operate in a certain manner or to perform certain operations described herein. Considering embodiments in which the processing element is temporarily configured (e.g., programmed), each of the processing elements need not be configured or instantiated at any one instance in time. For example, where the processing element comprises a general-purpose processor configured using software, the general-purpose processor may be configured as respective different processing elements at different times. Software may accordingly configure the processing element to constitute a hardware configuration at one instance of time and to constitute a different hardware configuration at a different instance of time.

Computer hardware components, such as communication elements, memory elements, processing elements, and the like, may provide information to, and receive information from, other computer hardware components. Accordingly, the described computer hardware components may be regarded as being communicatively coupled. Where multiple of such computer hardware components exist contemporaneously, communications may be achieved through signal transmission (e.g., over appropriate circuits and buses) that connect the computer hardware components. In embodiments in which multiple computer hardware components are configured or instantiated at different times, communications between such computer hardware components may be achieved, for example, through the storage and retrieval of information in memory structures to which the multiple computer hardware components have access. For example, one computer hardware component may perform an operation and store the output of that operation in a memory device to which it is communicatively coupled. A further computer hardware component may then, later, access the memory device to retrieve and process the stored output. Computer hardware components may also initiate communications with input or output devices, and may operate on a resource (e.g., a collection of information).

The various operations of example methods described herein may be performed, at least partially, by one or more processing elements that are temporarily configured (e.g., by software) or permanently configured to perform the relevant operations. Whether temporarily or permanently configured, such processing elements may constitute processing element-implemented modules that operate to perform one or more operations or functions. The modules referred to herein may, in some example embodiments, comprise processing element-implemented modules.

Similarly, the methods or routines described herein may be at least partially processing element-implemented. For example, at least some of the operations of a method may be performed by one or more processing elements or processing element-implemented hardware modules. The performance of certain of the operations may be distributed among the one or more processing elements, not only residing within a single machine, but deployed across a number of machines. In some example embodiments, the processing elements may be located in a single location (e.g., within a home environment, an office environment or as a server farm), while in other embodiments the processing elements may be distributed across a number of locations.

Unless specifically stated otherwise, discussions herein using words such as "processing," "computing," "calculating," "determining," "presenting," "displaying," or the like may refer to actions or processes of a machine (e.g., a computer with a processing element and other computer hardware components) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim(s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A dispenser for dosing treatment solutions into a sewer line, the dispenser comprising:

a container for holding a supply of the treatment solutions;

an attachment device for hanging the container in a manhole that is contiguous with the sewer line;

a conduit having one end connected to the container and another end that may be removed from the manhole and connected to a refill supply of the treatment solutions so the container may be refilled with the treatment solutions without removing the container from the manhole;

a pump positioned in the container for pumping the treatment solutions from the container to the sewer line;

a fluid level switch positioned in the container for sensing a fluid level of the treatment solutions in the container; and a control system electrically coupled with the pump and the fluid level switch, the control system configured to periodically operate the pump to dispense doses of the bacteria concentrate from the container into the sewer line and to not operate the pump when the fluid level switch senses a low fluid level of the bacteria concentrate in the container.

2. The dispenser of claim 1, the control system having a rechargeable battery for powering the pump and the level switch.

3. The dispenser of claim 2, the control system having a gauge for gauging a charge level of the rechargeable battery.

4. The dispenser of claim 2, wherein the rechargeable battery is a 12-volt, 100-amp hour lithium iron phosphate battery.

5. The dispenser of claim 1, the control system having a charging connector coupled with the rechargeable battery, the charging connector configured to couple with a charging cable that may be connected to a power source outside the manhole for recharging the rechargeable battery.

6. The dispenser of claim 1, the control system having a transmitter for transmitting data representative of the fluid level of the treatment solutions in the container and the charge level of the rechargeable battery to an external communication device.

7. The dispenser of claim 6, wherein the transmitter is a cellular transmitter or a Bluetooth transmitter for wireless communication between the control system and the external communication device.

8. The dispenser of claim 1, further comprising an electrical junction box disposed between the control system and the pump and the level switch for delivering power from the control system to the pump and the level switch.

9. The dispenser of claim 8, the control system further comprising an electrical port and a cable connected between the electrical port and the electrical junction box so that the control system may be removed from the manhole while still powering and controlling the pump and the level switch.

10. The dispenser of claim 1, the pump having an outlet port, the dispenser further comprising a hose having a proximal end connected to the outlet port and a distal end that extends from the container and that may be selectively positioned for delivering the treatment solutions from the pump to the sewer line.

11. The dispenser of claim 10, further comprising a check valve coupled with the distal end of the hose.

12. A dispenser for dosing bacteria concentrate into a sewer line, the dispenser comprising:

a container with a lid for holding a supply of the bacteria concentrate;

straps for hanging the container in a manhole that is contiguous with the sewer line;

a conduit having one end connected through the lid of the container and another end that may be removed from the manhole and connected to a refill supply of the bacteria concentrate so the container may be refilled with the bacteria concentrate without removing the container from the manhole;

a pump positioned in the container for pumping the bacteria concentrate from the container to the sewer line, the pump having an outlet port;

a hose having a proximal end connected to the outlet port of the pump and a distal end that extends from the lid of the container and that may be selectively positioned for delivering the bacteria concentrate from the pump to the sewer line;

a fluid level switch positioned in the container for sensing a fluid level of the bacteria concentrate in the container; and a control system electrically coupled with the pump and the fluid level switch, the control system comprising— a controller for periodically operating the pump to dispense doses of the bacteria concentrate from the container into the sewer line and to not operate the pump when the fluid level switch senses a low fluid level of the bacteria concentrate in the container;

a rechargeable battery for powering the pump, the level switch, and the controllers;

a gauge for gauging a charge level of the rechargeable battery;

a charging connector coupled with the rechargeable battery, the charging connector configured to couple with a charging cable that may be connected to a power source outside the manhole for recharging the rechargeable battery; and a transmitter for transmitting data representative of the fluid level of the bacteria concentrate in the container and the charge level of the rechargeable battery to an external communication device.

13. The dispenser of claim 12, wherein the transmitter is a cellular transmitter or a Bluetooth transmitter for wireless communication between the controller and the external communication device.

14. The dispenser of claim 12, further comprising an electrical junction box disposed between the controller and the pump and the level switch for delivering power from the controller to the pump and the level switch.

15. The dispenser of claim 14, the controller further comprising an electrical port and a cable connected between the electrical port and the electrical junction box so that the control system may be removed from the manhole while still powering and controlling the pump and the level switch.

16. The dispenser of claim 12, further comprising a check valve coupled with the distal end of the hose.

17. The dispenser of claim 12, wherein the rechargeable battery is a 12-volt, 100-amp hour lithium iron phosphate battery.

18. A dispenser for dosing compounds into a liquid-carrying conduit, the dispenser comprising:

a container for holding a supply of the compounds;

an attachment device for hanging the container in the liquid-carrying conduit or an access point that is contiguous with the liquid-carrying conduit;

a conduit having one end connected to the container and another end that may be removed from the liquid-carrying conduit and connected to a refill supply of the compounds so the container may be refilled with the compounds without removing the container from the liquid-carrying conduit;

a pump positioned in the container for pumping the compounds from the container to the liquid-carrying conduit;

a fluid level switch positioned in the container for sensing a fluid level of the compounds in the container; and a controller electrically coupled with the pump and the fluid level switch, the controller configured to periodically operate the pump to dispense doses of the compounds from the container into the liquid-carrying conduit and to not operate the pump when the fluid level switch senses a low fluid level of the compounds in the container.

19. The dispenser of claim 18, the controller having a rechargeable battery for powering the pump, the level switch, and electronics in the controller, the controller having a gauge for gauging a charge level of the rechargeable battery.

20. The dispenser of claim 19, further comprising a mobile application that executes on a mobile phone, the controller having a transmitter for transmitting data representative of the fluid level of the compounds in the container and the charge level of the rechargeable battery to a phone network in communication with the external communication device so that the mobile application may display information representative of the fluid level of the compounds in the container and the charge level of the rechargeable battery.

* * * * *